US005752389A

United States Patent [19]

Harper

[11] Patent Number: 5,752,389

[45] Date of Patent: May 19, 1998

[54] COOLING AND DEHUMIDIFYING SYSTEM USING REFRIGERATION REHEAT WITH LEAVING AIR TEMPERATURE CONTROL

[76] Inventor: Thomas H. Harper, 303 Ashley Rd., Dyersburg, Tenn. 38024

[21] Appl. No.: 729,878

[22] Filed: Oct. 15, 1996

[51] Int. Cl.[6] ..... F25B 49/00

[52] U.S. Cl. ..... 62/176.5; 62/184; 62/524

[58] Field of Search ..... 62/173, 176.5, 62/184, 524, 90

[56] References Cited

U.S. PATENT DOCUMENTS

| | | | |
|---|---|---|---|
| 3,139,735 | 7/1964 | Malkoff et al. | 62/90 |
| 3,293,874 | 12/1966 | Gerteis | 62/176.5 X |
| 3,316,730 | 5/1967 | Lauer | 62/173 |
| 3,738,117 | 6/1973 | Engel | 62/90 X |
| 3,958,429 | 5/1976 | Kirsch | 62/184 |
| 4,271,678 | 6/1981 | Liebert . | |
| 4,287,722 | 9/1981 | Scoh . | |
| 5,088,295 | 2/1992 | Shpiro-Baruch . | |
| 5,228,302 | 7/1993 | Elermann . | |
| 5,265,433 | 11/1993 | Beckwith | 62/173 X |
| 5,509,272 | 4/1996 | Hyde . | |

OTHER PUBLICATIONS

Moisturemiser AC Unit By Carriel AC Co. Sep. 1, 1995.

*Primary Examiner*—Henry A. Bennett
*Assistant Examiner*—Susanne C. Tinker

[57] ABSTRACT

An air conditioning apparatus, capable of cooling, dehumidifying, and reheating air, using refrigeration reheat. The apparatus comprises rooftop unit (1), which includes a standard refrigeration loop for cooling operation. A multiple circuit reheat coil (54), is added in a parallel arrangement with outdoor coil (34), with respect to refrigerant flow. A portion of the hot refrigerant gas of the system is diverted through reheat coil (54) during dehumidification mode, to reheat the supply air to room temperature. A multiple step discharge air control system is included to control multiple stop valves (52) during the dehumidification mode. Reheat coil (54) is arranged in series air flow relationship with evaporator coil (46), so that a mixture of any proportion of outside air and return air may be conditioned. A pressure control (28) is provided to maintain system pressure during all modes of operation. In another embodiment, a one step reheat coil (54) arrangement is provided using room temperature (70) for control of one stop valve (51). The invention is particularly suited to applications where temperature and humidity need be controlled within close parameters, when fresh air and constant blower operation are used. The invention is also particularly suited to 100% outdoor air applications, such as spot cooling.

1 Claim, 5 Drawing Sheets

COOLING AND DEHUMIDIFYING SYSTEM USING REFRIGERATION REHEAT WITH LEAVING AIR TEMPERATURE CONTROL

BACKGROUND

1. Field of the Invention

This invention relates to the field of air conditioning generally, and in particular it relates to the control of temperature and humidity during the cooling season, using air conditioning with refrigeration reheat.

2. Prior Art

Typically, air conditioning system designers have sized air conditioning units to overcome given sensible and latent cooling requirements which occur at maximum outdoor design conditions. Generally speaking, at maximum outdoor design conditions units are sized to closely match the sensible cooling requirement. The selected unit almost always has excess latent cooling capacity at design conditions. Nearly all systems are controlled by a sensible heat sensing device only, i.e., a thermostat. The thermostat, by reacting to the sensible heat requirement, forces the unit to run much of the time during maximum outside design conditions. Normally the amount of run time on a design day also maintains the space relative humidity at acceptable levels. This happens because latent cooling occurs as a by-product of the sensible cooling process.

However, design conditions occur for only a few hours each year. During most of the cooling season the load will be less than the maximum and the unit will have an excess amount of sensible capacity. The amount of unit run time will decrease proportionally as the sensible load deviates from the maximum. This lessening amount of run time satisfies the sensible cooling requirement. However, the latent cooling load, which many times will not be reduced proportionally with the sensible load, is not satisfied. The unit can dehumidify only when it is running. Therefore, as the amount of run time is decreased, the relative humidity in the space rises. This occurs during the time of the year when the ambient moisture conditions are higher than the desired room conditions. This has especially been a problem when the unit serving the space incorporates a fresh air inlet damper. Constant operation of the unit blower, along with an open fresh air inlet damper, greatly increases space relative humidity during periods of light sensible loads. There has been a growing concern in the air conditioning industry in recent years about indoor air quality. A lack of adequate ventilation air has been cited as a major part of the problem. The American Society of Heating, Refrigerating and Air-Conditioning Engineers, Inc. has published ANSI/ASHRAE standard 62-1989 which has been adopted by many local building codes. This code specifies a sharp increase in the minimum amount of ventilation air over the previous code, as well as constant blower operation for most applications. It states that "ventilating systems for spaces with intermittent or variable occupancy may have their outdoor air quantity adjusted by use of dampers or by stopping and starting the fan system to provide sufficient dilution to maintain contaminant concentrations within acceptable levels at all times." This implies that most other applications should maintain constant fan circulation. An example of a typical application with intermittent or variable occupancy, might be an auditorium which sits empty most of the time. The implementation of this new code, along with constant blower operation, increases high humidity conditions unless some form of dehumidification control, along with reheat is applied. My invention solves this problem by providing an air conditioning unit and control system to dehumidify and reheat the air in applications which incorporate ventilation air quantities from 0 to 100%, and at all load conditions from maximum to minimum.

The occupants of a space where the humidity is not controlled, and is allowed to rise above 50% at 75 degrees, normally complain about stuffiness and etc. The usual answer to the problem has been to lower the thermostat setpoint thereby forcing the unit to run. This lowered the space temperature to a point lower than the design intent. The result has been a lower amount of moisture in the space, but also results in complaints of coolness from the occupants. It has also resulted in greatly increased utility cost. Normal air conditioning design temperatures for many parts of the United States are 95 degrees outdoors and 75 degrees indoors. Many occupants have lowered the thermostat setpoint from the 75 degrees design point to 70 degrees when the space humidity level has become objectionable. This would mean an increase of as much as 25% in utility cost in many cases if the setpoint were maintained at 70 degrees all season long. My invention saves operating costs by allowing a higher temperature setting for the space thermostat, while maintaining the humidity at a comfortable level.

In the past, most systems were controlled as described above with the exception of computer rooms, laboratories, and process type applications. Most of these special applications added a dehumidistat to the control scheme. The dehumidistat was used to override the cooling thermostat and turn on the air conditioning unit, on a rise in space humidity. As the room began to overcool, the space thermostat would energize some form of heating apparatus. This heating apparatus was always required to be located in series flow relationship with the air conditioning cooling coil. Thus the air is first cooled to remove the moisture and then reheated to the room temperature. This type of control scheme has typically resulted in a large variance in temperature and humidity in the space. The problem has been that the heating and cooling temperature setpoints are many times, accidentally or on purpose, separated by much more than the minimum of approximately 3 degrees. The result has been that the unit wasted energy by overcooling the room to a much lower temperature than is necessary. Also, since relative humidity varies inversely to the temperature, a large rise in space relative humidity results when a large drop in space temperature occurs. The net effect is poor control of both temperature and humidity. No patent has been found for this control scheme. It has been very economical to purchase and install, and has been the industry standard for many years. My invention solves all of the above problems by providing an air conditioning system that will provide refrigeration reheat during the dehumidification mode, controlled by a discharge air thermostat. The setpoint of the discharge air thermostat is the same as the room cooling temperature setpoint. Thus the normal temperature "droop" associated with conventional control systems will be eliminated. It is common knowledge in the industry that in order to control humidity at close tolerances, the temperature must be held within close parameters.

The forms of reheat that have been used are electric, gas, hydronic, and refrigeration. Electric has been the most popular because many steps of control are available. Refrigeration reheat has been the least used because of its cost and complexity. Electric, gas, and hydronic reheat all have a distinct disadvantage in that an alternate source of energy is required. Many states have adopted energy codes that prohibit reheat using an alternate energy source except for special processes and the like.

Refrigeration reheat, on the other hand, has been quite complicated, both to install and maintain. It was first used mostly in supermarket applications. It was used primarily to provide heat to the store that would have been otherwise wasted by the food refrigeration systems. A typical system involved several different refrigeration units, each having a 3-way heat reclaim valve. Each heat reclaim valve diverted the entire flow of its respective unit's hot refrigerant gas to a hot gas reheat coil. The hot gas reheat coil was positioned in the airstream of the store air conditioning system. It was located downstream of the store cooling coil and upstream of the store heating coil. Thus it became the first stage of heat for heating the store. The alternate source of heat which usually was gas, became the second stage of heating. The result was a significant savings in store heating costs. However, these systems have been typically expensive to install and complicated as shown in U.S. Pat. No. 4,287,722 (1981), issued to Scott. This patent describes an apparatus that is capable of providing refrigeration for the food cases in a supermarket, and heating the store with waste heat from the refrigeration compressor at the same time. The same coil that is capable of heating the store, can also cool the store. No mention is made of humidity control although refrigeration reheat is used. Also, when several compressors are used in combination as described, this invention becomes expensive to install and complicated to maintain. My invention provides an economical factory packaged type product which is simple to manufacture, install and maintain. It will also control both temperature and humidity using a minimum of components. Another invention, which does mention humidity control using refrigeration reheat, is U.S. Pat. No. 5,228,302 (1993), issued to Elermann. This invention is a very complicated apparatus in which one embodiment uses refrigeration reheat to obtain 70% relative humidity in the duct system. A combination of heat exchanger, pumps, variable speed drive, precooling coil, cooling coil, and reheat coil is used to reheat the air to a temperature which corresponds to 70% relative humidity in the duct system, but is less than the normal room design temperature. U.S. Pat. No. 4,271,678 (1981), issued to Liebert, which is similar to U.S. Pat. No. 5,228,302, describes an invention which uses refrigeration reheat for humidity control. The control system uses return air sensors for temperature and humidity control. This invention is also very complicated and uses many of the same components as found in U.S. Pat. No. 5,228,302. My invention reheats the air from the cooling discharge temperature, to the normal room temperature using a minimum of heat exchange devices with a simple control system.

U.S. Pat. No. 5,509,272 (1996), issued to Hyde describes an invention comprising a conventional air conditioning system with a reheat coil and a liquid refrigerant pump. The pump is used to enhance the efficiency of the system. The air is reheated using a liquid subcooler coil instead of a hot gas reheat coil. The coil receives liquid that has been cooled by the standard outdoor condenser coil. This liquid is then further cooled since the subcooler coil is placed downstream from the cooling coil. This process in turn partially reheats the air and lowers the pressures in the system so that the unit will remove more moisture from the air. My invention provides discharge air which is fully reheated to normal room temperature. It also provides discharge air which is lower in moisture content during the dehumidification mode as opposed to the cooling only mode. The extra moisture removal is produced without the expense of operating a pump. The efficiency of the unit is also improved during the dehumidification process as the unit operates at lower pressures.

U.S. Pat. No. 5, 088,295 (1992), issued to Shapiro-Baruch describes an invention in which a refrigeration heater coil is placed in parallel flow relationship with the evaporator coil of an air conditioner. Both coils share the same coil heat transfer fins. This invention also provides two throttling devices, better known as refrigerant expansion devices, in the refrigerant piping loop. One device is used during cooling only operation, and both devices are used during the dehumidification mode. This arrangement presents a dilemma to the designer in sizing the throttling device used for cooling only operation. A certain amount of pressure drop through the expansion device is required for proper operation of the refrigeration system. During cooling only operation, the expansion device would need to be sized based on 100% of the refrigerant flow. During the dehumidification mode, each device should be sized based on approximately 50% of the refrigerant flow. Therefore, if the cooling only device is sized for 100% of the flow, poor performance due to low pressure would result when the system operates in the dehumidification mode at 50% flow. Conversely, if the cooling only device is sized for 50% flow during cooling, performance of the unit would be affected because of the large pressure drop through the throttling device. This invention, as well as mine, effectively increases the heat transfer surface of the condenser portion of the refrigeration system. In applications such as this, a head pressure control means will be needed to provide stable operation over the wide range of operating conditions encountered. The combination of two throttling devices, along with the lack of a head pressure control device, greatly diminishes the performance of this invention during all but maximum load conditions. Also this invention does not provide a check valve at the outlet of the heater coil. A check valve at this location prevents hot refrigerant gas from occupying the heater coil when it is idle. If hot gas is allowed to occupy the heater coil when it is idle, it will condense to liquid, thereby altering the amount of refrigerant charge available for circulation in the system.

When this invention is in operation during the dehumidification mode, hot refrigerant gas is allowed to circulate through the heater coil portion and liquid refrigerant is allowed to pass through the evaporator coil portion. Thus cooling is accomplished in one portion of the coil and heating in the other. This invention does not address the problem of mixing return air and ventilation air. Most building codes require the system to provide a mixture of return air and outside air for ventilation. When this invention is applied to a system requiring ventilation air, the high temperature and humidity contained in the outside air that passes through the heater coil will not be removed. Therefore, the dew point of the air leaving the unit will rise, since only that portion of the outside air that passes through the cooling coil will have its moisture level reduced. My invention solves this problem by being capable of cooling, dehumidifying, and reheating a mixed air stream of any proportion of outside and return air. The leaving dewpoint of the air will be lower during dehumidification mode, as compared to the cooling only mode. Also, my invention provides one throttling device which is easily sized to handle 100% of the refrigerant flow. My invention also provides a check valve arrangement to prevent refrigerant from occupying the heater coil when it is idle.

It has apparently been unobvious to industry designers that refrigeration reheat could be applied economically, using multiple step discharge air control in a single packaged type air conditioner. It has also apparently been unobvious to industry designers that the accuracy of temperature and humidity control systems could be improved simply by using discharge air control of reheat during the dehumidification mode. The trend for the use of refrigeration reheat has evolved from heat reclaim only, in early patents such as U.S. Pat. No. 4,287,722 issued to Scott in 1981, to humidity control, in later patents such as U.S. Pat. No. 5,228,302 issued to Elermann in 1993. The Patent to Shaprio-Baruch, U.S. Pat. No. 5, 088,295, issued in 1992, was awarded well after the 1989 ANSI/ASHRAE 62-1989 Standard was in effect, requiring an increase in ventilation air. It was apparently unobvious to the inventor that a series flow arrangement for the reheat coil was needed to maintain space relative humidity while meeting both the old and new code. It was also apparently unobvious to the inventor that an arrangement containing the two throttling devices, but lacking check valves and a head pressure control means, would cause operating difficulties. Because of cost and complexity, the trend has changed in more recent times away from refrigeration reheat, toward using liquid subcooling with partial reheating, as shown in U.S. Pat. No. 5, 509,272 issued to Hyde in 1996. Also, the Carrier Air Conditioning Company has developed an air conditioning unit very similar to the patent issued to Hyde, except for the refrigerant pump. This unit was developed in 1995, and is being marketed presently. The ANSI/ASHRAE 62-1989 which is currently in effect specifies that habitable spaces should be maintained between 30% and 60% relative humidity. The present invention is needed to provide a simple and economical solution to the problem of humidity control in habitable spaces.

The foregoing problems are solved with the design of the present invention by providing a more efficient air conditioner that will control temperature and humidity accurately, and can be economically mass produced using multiple step refrigeration reheat with discharge air control, while conditioning a mixture of any proportion of return and outside air.

OBJECTS AND ADVANTAGES

It is accordingly one object of the present invention to provide an air conditioning unit with refrigeration reheat that will maintain temperature and humidity at acceptable levels from maximum load conditions to minimum load conditions while providing constant fresh air ventilation rates from 0 to 100%, using continuous blower operation.

It is another object of the present invention to provide an air conditioning unit with refrigeration reheat that will maintain humidity at lower levels, allowing the space temperature to be maintained at a higher setpoint, thereby reducing energy cost.

It is a further object of the present invention to provide an air conditioning unit with refrigeration reheat, controlled by a discharge air thermostat in multiple steps, which will eliminate the temperature droop that normally occurs in prior conventional control systems.

It is another object of the present invention to provide an air conditioning unit with refrigeration reheat that can be economically mass produced, using a minimum of components and a simple control system.

It is another object of the present invention to provide an air conditioning unit that uses a minimum number of heat exchange devices to reheat the air during the dehumidification mode, from the cooling temperature to the normal room temperature.

It is a further object of the present invention to provide an air conditioning unit with refrigeration reheat that will be more efficient while operating in the dehumidification mode during high moisture conditions, as opposed to the standard cooling operation, thereby minimizing run time and saving energy.

It is another object of the present invention to provide an air conditioning unit that will provide the same efficiency while operating in the dehumidification mode during low moisture conditions, as compared to the cooling mode, thereby maximizing run time to prevent detrimental short cycling of the compressor.

It is a further object of the present invention to provide an air conditioning unit with refrigeration reheat that will cool, dehumidify, and reheat a mixture of return air and outside air of any proportion.

It is further object of the present invention to provide an air conditioning unit with refrigeration reheat, using only one throttling device, and a check valve arrangement, whereby stable refrigeration system operation is accomplished.

These and other objects and advantages are obtained by providing an economically mass produced air conditioning unit, that will efficiently maintain space temperature and humidity at all load conditions, while handling any proportion of outside and return air, using multiple steps of refrigeration reheat controlled by a discharge air thermostat.

Further objects and advantages of my invention will become apparent from a consideration of the drawings and ensuing description.

REFERENCE NUMERALS USED IN DRAWINGS

| | | | |
|---|---|---|---|
| 10 | Rooftop Unit | 11 | Condenser Section |
| 12 | Curb | 13 | Indoor Section |
| 14 | Return Inlet | 16 | Fresh Air Inlet |
| 17 | Indoor Air Arrow | 18 | Plenum |
| 20 | Filters | 22 | Compressor |
| 24 | Hot Gas Header | 25 | Refrigerant Arrow |
| 26 | Condenser Fan Motor | 27 | Hot Gas Tee |
| 28 | Pressure Controller | 29 | Outdoor Fan |
| 30 | Pressure Sensor | 31 | Dividing Wall |
| 32 | Hot Gas Line | 33 | Condenser Arrow |
| 34 | Outdoor Coil | 35 | Sensor Wire |
| 36 | Outdoor Liquid Line | 37 | Output Wire |

-continued

| | | | |
|---|---|---|---|
| 38 | Common Liquid Line | 40 | Filter Drier |
| 42 | Expansion Device | 44 | Feeder Tubes |
| 46 | Evaporator Coil | 47 | Suction Header |
| 48 | Suction Line | 50 | Reheat Gas Line |
| 51 | Medium Stop Valve | 52 | Small Stop Valve |
| | | 54 | Reheat Coil |
| 56 | Small Check Valve | 57 | Liquid Line Tee |
| 58 | Indoor Liquid Line | 59 | Large Check Valve |
| 60 | Indoor Blower | 62 | Winter Heat Section |
| 64 | Discharge Air | 65 | Voltage Connection |
| 66 | Control Transformer | 67 | Ground Connection |
| 68 | Auto-Off Switch | 69 | Heating Contact |
| 70 | Room Thermostat | 71 | Cooling Contact |
| 72 | Dehumidistat | 73A | Contact |
| 73B | Contact | 74 | Cooling Relay |
| 75 | Common Point | 76 | Dehumidifying Relay |
| 78 | Heat Lockout Relay | 80A | Contact |
| 80B | Contact | 80C | Contact |
| 80D | Contact | 80E | Contact |
| 90A | Contact | 90B | Contact |
| 90C | Contact | 96A | Contact |
| 96B | Contact | 100 | Indoor Blower Relay |
| 102 | Winter Heater Relay | 104 | Compressor Relay |
| 105 | Reheat Transformer | 106 | Temperature Sensor |
| 107 | Step Controller | 108 | Duct Thermostat |

DESCRIPTION—FIGS. 1, 2, 3, 4, 5, 6, AND 7

Figure 1:
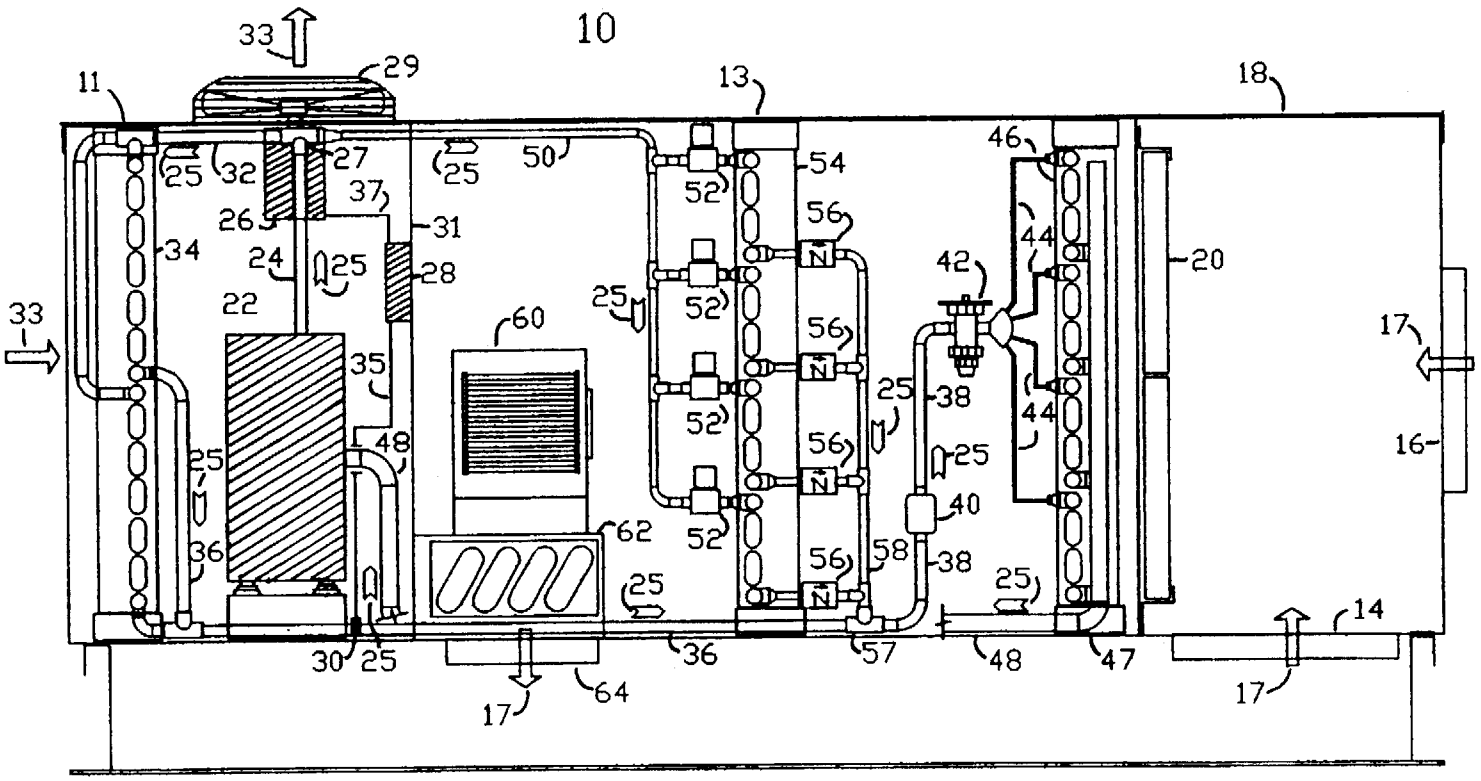
FIG. 1 shows a cross-section of the side elevation of a typical rooftop air conditioning unit constructed according to the present invention. All major components, as well as the flow path both refrigerant and air are shown.

FIG. 1 shows a typical mass produced packaged type air conditioning unit 10 mounted on a curb 12. The unit cabinetry is divided into three principle parts, comprising a condenser section 11, indoor section 13, and plenum section 18. Indoor section 13 and condenser section 11 are separated by dividing wall 31. Items such as reheat gas line 50, small stop valves 52, small check valves 56, indoor liquid line 58, common liquid line 38, filter drier 40, expansion device 42, feeder tubes 44, and suction line 48 are commonly located in condenser section 11. These items are illustrated in the indoor section 13 only for clarity purposes.

The airflow path through the unit is shown by airflow arrows 17. Return air from the space enters the unit at return inlet 14. Fresh air enters the unit at fresh air inlet 16. Return air and fresh air are mixed in plenum 18 and filtered by filters 20. The mixed air stream then passes through evaporator coil 46 where it is cooled and dehumidified. The air then passes through reheat coil 54 where it is reheated to room temperature. Indoor blower 60 is used to create the indoor airflow path. Air is discharged from indoor blower 60 through winter heat section 62, and exits rooftop unit 10 through discharge air opening 64.

The refrigerant flow path is shown by refrigerant arrows 25. The cooling components are described first. Almost all refrigerant piping connections are made using some form of solder joint. This will be the assumed connection method for all refrigerant piping components used in this invention. Compressor 22 is connected to hot gas header 24 on one end. The other end of hot gas header 24 is connected to the inlet of hot gas tee 27. Hot gas tee 27 has one inlet and two outlets. During cooling operation hot gas is diverted to hot gas line 32, which is connected to hot gas tee 27 at one of its outlets. Hot gas does not flow from the other outlet of hot gas tee 27 during cooling only operation. This is because small stop valves 52 remain closed during cooling only operation. The other end of hot gas line 32 is connected to outdoor coil 34 where all system hot refrigerant gas is condensed to liquid during the cooling only mode of operation. The outlet of outdoor coil 34 connects to outdoor liquid line 36. Outdoor liquid line 36 is connected at its opposite end to one inlet of liquid line tee 57. Liquid line tee 57 has two inlets and one outlet. The other inlet of liquid line tee 57 is connected to indoor liquid line 58. Reverse refrigerant flow is prevented due to the connection of small check valves 56 at the opposite end of indoor liquid line 58. The outlet of liquid line tee 57 is connected to one end of common liquid line 38. The other end of common liquid line 38 is connected to the inlet of filter drier 40. The outlet end of filter drier 40 is connected to the inlet of another section of common liquid line 38. The outlet end of common liquid line 38 is connected to the inlet connection of expansion device 42. The outlet connection of expansion device 42 is connected to the inlet of multiple feeder tubes 44. The outlets of feeder tubes 44 are connected to the inlet tubes of evaporator coil 46. Liquid refrigerant is evaporated in evaporator coil 46 and exits through suction header 47. Suction header 47 is connected at its outlet to the inlet of suction line 48. The outlet of suction line 48 is connected to the inlet of compressor 22. Thus a standard refrigeration loop is completed for a cooling only operation.

The refrigeration reheat portion of the refrigeration system begins at hot gas line tee 27. It should be noted here that the components of the refrigeration reheat portion of the present invention are not sized to accommodate the full flow of hot gas. Only a portion of the unit hot gas flow is diverted through the reheat system flow path during the dehumidification mode of operation. The remaining portion flows through the normal cooling operation path. The pressure drop through each path is balanced to provide enough hot gas to reheat the supply air to normal design room temperature. Reheat gas line 50 is connected at its inlet to the remaining outlet of hot gas tee 27. The outlet of reheat gas line 50 is connected to the inlets of multiple small stop valves 52 in a parallel arrangement. Each outlet of small stop valves 52 is connected to its respective circuit of reheat coil 54. The term "small stop valve" in the present invention signifies a stop valve capable of passing one fourth of the reheat gas flow. Hot refrigerant gas is condensed to liquid in reheat coil 54 and exits to the inlet of multiple small check valves 56 which are arranged in a parallel fashion. The term "small check valve" indicates a valve sized for one fourth of the reheat gas flow in this invention. The outlets of check valves 56 are connected to the inlet of indoor liquid line tee 58. The outlet of indoor liquid line 58 is connected to one of the inlets of liquid line tee 57. The liquid which has been condensed by reheat coil 54 joins the liquid which has been condensed by outdoor coil 34. This mixture of the two streams of liquid continues through common liquid line 38, filter drier 40, expansion device 42, feeder tubes 44, evaporator coil 46, suction header 47, suction line 48, and compressor 22 to complete a refrigeration loop in the dehumidification mode.

The condenser airflow path is shown by condenser arrows 33. Outdoor air enters condenser section 11 through outdoor coil 34 as shown by condenser arrows 33. Outdoor air is exhausted from condenser section 11 of rooftop unit 10 by outdoor fan 29. Outdoor fan 29 is operated by condenser fan motor 26. Pressure controller 28 is mounted on dividing wall 31. Pressure controlled 28 is connected at it output point by output wire 37 to condenser fan motor 26. Sensor 30 is mounted in contact with outdoor liquid line 36. Sensor wire 35 connects sensor 30 to pressure controller 28.

Figure 2:
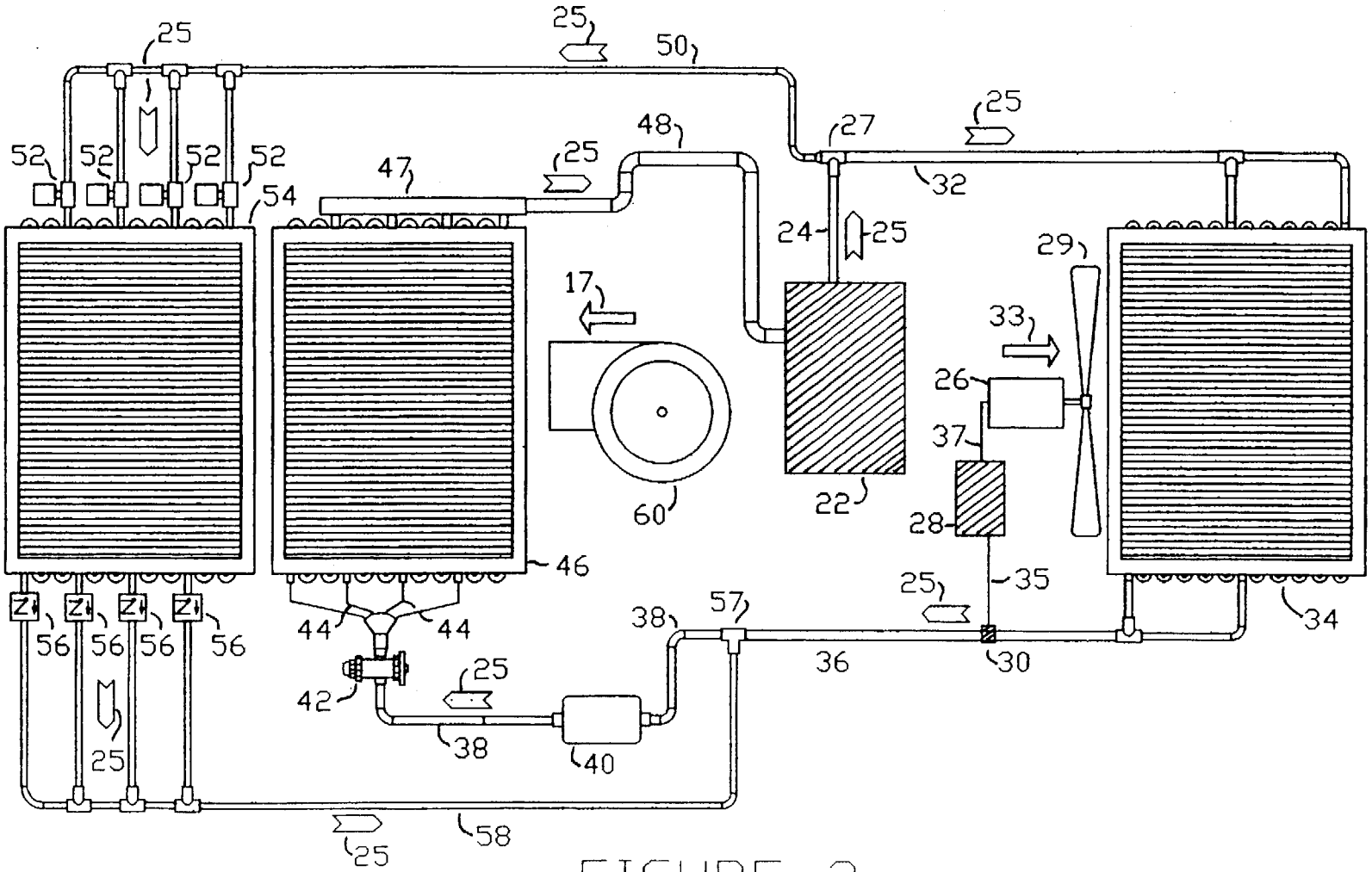
FIG. 2 depicts a schematic diagram of the refrigeration components of the present invention. A refrigeration reheat coil using four stop valves is shown, along with all major system components.

FIG. 2 depicts a schematic diagram of the refrigeration system according to the present invention. A system which uses 4 stages of refrigeration reheat is shown. The refrigerant flow path is shown by refrigerant arrows 25.

Compressor 22 hot gas discharge outlet is connected to the inlet of hot gas header 24. The outlet of hot gas header 24 is connected to the inlet of hot gas tee 27. The cooling mode outlet of hot gas tee 27 is connected to the inlet of hot gas line 32. The outlet of hot gas line 32 is connected to outdoor coil 34. Hot refrigerant gas is condensed to liquid in outdoor coil 34 and exits to the inlet of outdoor liquid line 36. Outdoor liquid line 36 is connected at its outlet to one inlet of liquid line tee 57. The other inlet of liquid line tee 57 is connected to indoor liquid line 58. Reverse flow into reheat coil 54 is prevented by multiple small check valves 56, located in indoor liquid line 58. This prevents refrigerant condensation from occurring in reheat coil 54 when it is idle during cooling only operation. Should refrigerant condense in reheat coil 54 when it is idle, the operating portion of the system would be short of refrigerant. This would be detrimental to the cooling efficiency and the life of the compressor. The outlet of liquid line tee 57 is connected to the inlet of one section of common liquid line 38. The outlet of this section of common liquid line 38 is connected to the inlet of filter drier 40. The outlet of filter drier 40 is connected to the inlet of another section of common liquid line 38. The outlet of this section of common liquid line 38 is connected to the inlet of expansion device 42. An expansion valve is shown for expansion device 42, however other devices can be used. The outlet of expansion device 42 is connected to the inlet of multiple feeder tubes 44. The outlet of feeder tubes 44 are connected to the inlet connections of evaporator coil 46. The liquid refrigerant is evaporated in evaporator coil 46 and exits as vapor through suction header 47. The outlet of suction header 47 is connected to the inlet connection of suction line 48. The outlet connection of suction line 48 is connected to the suction connection of compressor 22. Thus a complete refrigeration loop is formed for use in a cooling only configuration.

The refrigeration reheat portion of the invention is described next. The refrigeration reheat section begins at the other outlet of hot gas tee 27 which is connected to the inlet of reheat gas line 50. The outlet of reheat gas line 50 terminates at the inlet of multiple small stop valves 52 in a parallel arrangement. The outlets of stop valves 52 are connected to the inlets of reheat coil 54. Hot refrigerant gas is condensed in reheat coil 54 and exits as liquid to the inlets of multiple small check valves 56. The outlets of small check valves 56 are connected in parallel to the inlet of indoor liquid line 58. The outlet of indoor liquid line 58 is connected to one of the inlets of liquid line tee 57. A check valve is not required in outdoor liquid line 36 as refrigerant is flowing through outdoor liquid line 36 during both cooling and dehumidification modes. The two streams of liquid, one from outdoor liquid line 36, the other from indoor liquid line 58, join within liquid line tee 57. The outlet of liquid line tee 57 is connected to the inlet of common liquid line 38. Refrigerant then flows through filter drier 40, common liquid line 38, expansion device 42, feeder tubes 44, evaporator coil 46, suction header 47, suction line 48, and compressor 22, back to the point of beginning. Thus a common refrigeration loop is completed using both outdoor coil 34, and reheat coil 54, in a parallel arrangement with respect to refrigerant flow.

Condenser fan 29 is connected to condenser fan motor 26 to provide air flow through outdoor coil 34. The path is shown by condenser arrow 33. Pressure controller 28 is connected at its output point to output wire 37. The other end of wire 37 terminates at condenser fan motor 26. Pressure controller 28 is connected at its input point to sensor wire 35. The other end of sensor wire 35 is connected to sensor 30. Sensor 30 is fastened to outdoor liquid line 36. A condenser fan motor speed control is described, however other forms of head pressure control can be used.

Indoor blower 60, circulates air through evaporator coil 46, and reheat coil 54, which are arranged in series with respect to indoor air flow. Indoor airflow is indicated by airflow arrow 17.

Figure 3:
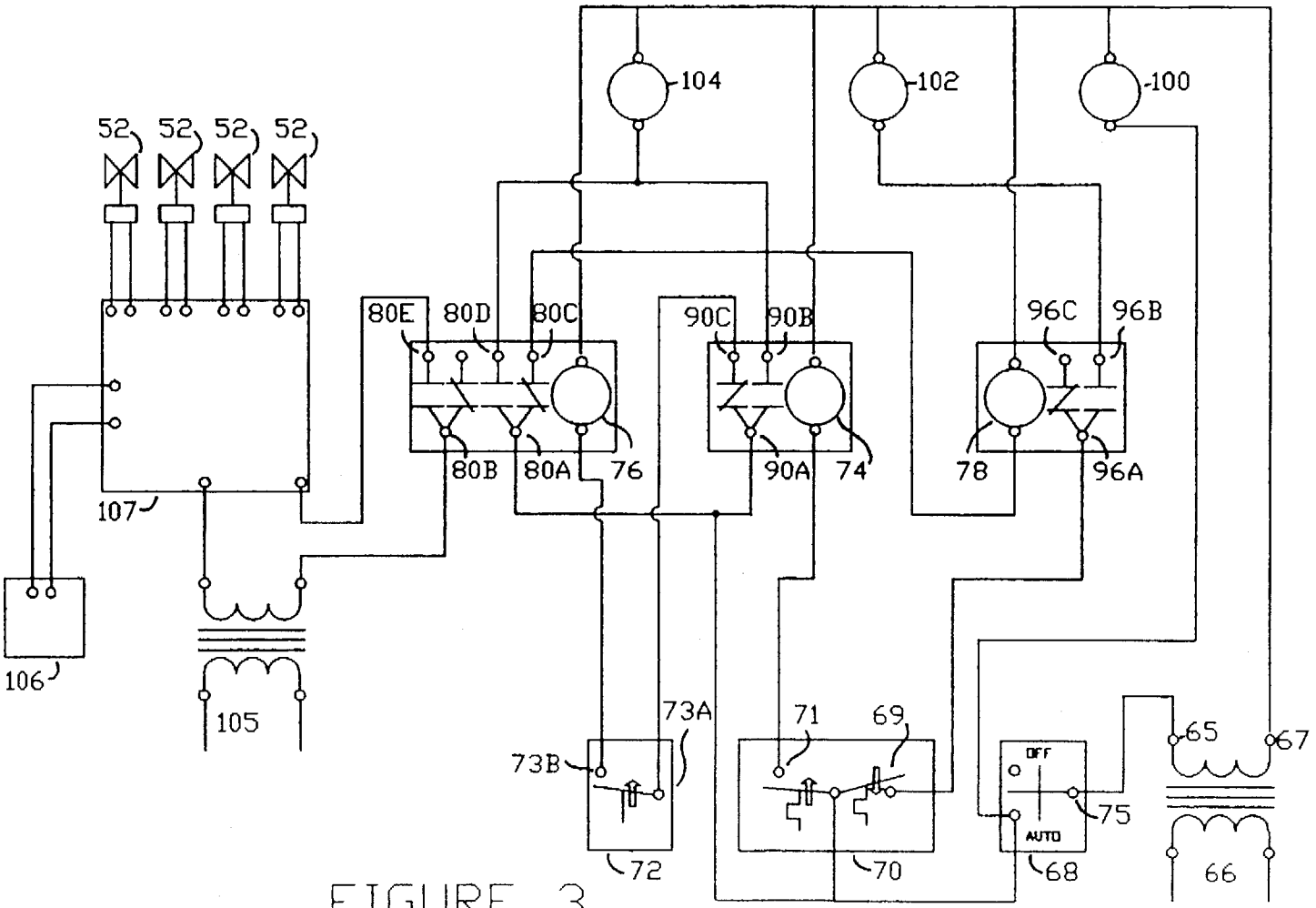
FIG. 3 is an illustration of a typical control wiring diagram for the present invention as constructed in FIG. 2. A four step discharge air control scheme is shown for the refrigeration reheat coil.

FIG. 3 shows a control scheme according to the present invention as described in FIG. 1 and FIG. 2. Power source 66 which is typically a factory installed transformer, provides low voltage control power to operate the system. All connections between control components are typically made through low voltage wiring. This description assumes that method unless noted elsewhere. Ground connection 67 is connected to all relays with no interruptions. Voltage connection 65 is connected to auto-off switch 68 at common point 75. Auto switch 68 is in turn connected to room thermostat 70 through its auto connection point. Also contacts 80A on dehumidifying relay 76, and contact 90A on cooling relay 74 are directly connected to the auto connection point on auto-off switch 68. Indoor blower relay 100 is also connected to the auto connection point of auto-off switch 68. Heating contact 69 of thermostat 70 is connected to winter heater relay 102 through contacts 96A and 96B of heat lockout relay 78. Cooling contact 71 of thermostat 70 is connected to cooling relay 74. Compressor relay 104 is connected to control power through relay contacts 90A and 90B of relay 74. Dehumidistat 72 is connected to dehumidifying relay 76 through dehumidistat contacts 73A and 73B. Dehumidistat 72 receives power through contacts 90A and 90C of relay 74. Dehumidifying relay 76 provides power to compressor relay 104 through contacts 80A and 80D. Dehumidifying relay locks out winter heat through contacts 80A and 80C. Dehumidifying relay 76 connects control power to the refrigeration reheat step controller 107 through contacts 80B and 80E. Reheat transformer 105 supplies power to step controller 107 through action of contacts 80B and 80E of dehumidifying relay 76. Temperature sensor 106 is connected to step controller 107 to provide temperature input. Small stop valves 52 are connected to the output points of step controller 107. FIGS. 1, 2 and 3 depict the preferred embodiment of the present invention when used in a 100% outdoor air application. Four stage reheat control provides better results in 100% outdoor air applications due to the large variations that occur in temperature.

Figure 4:
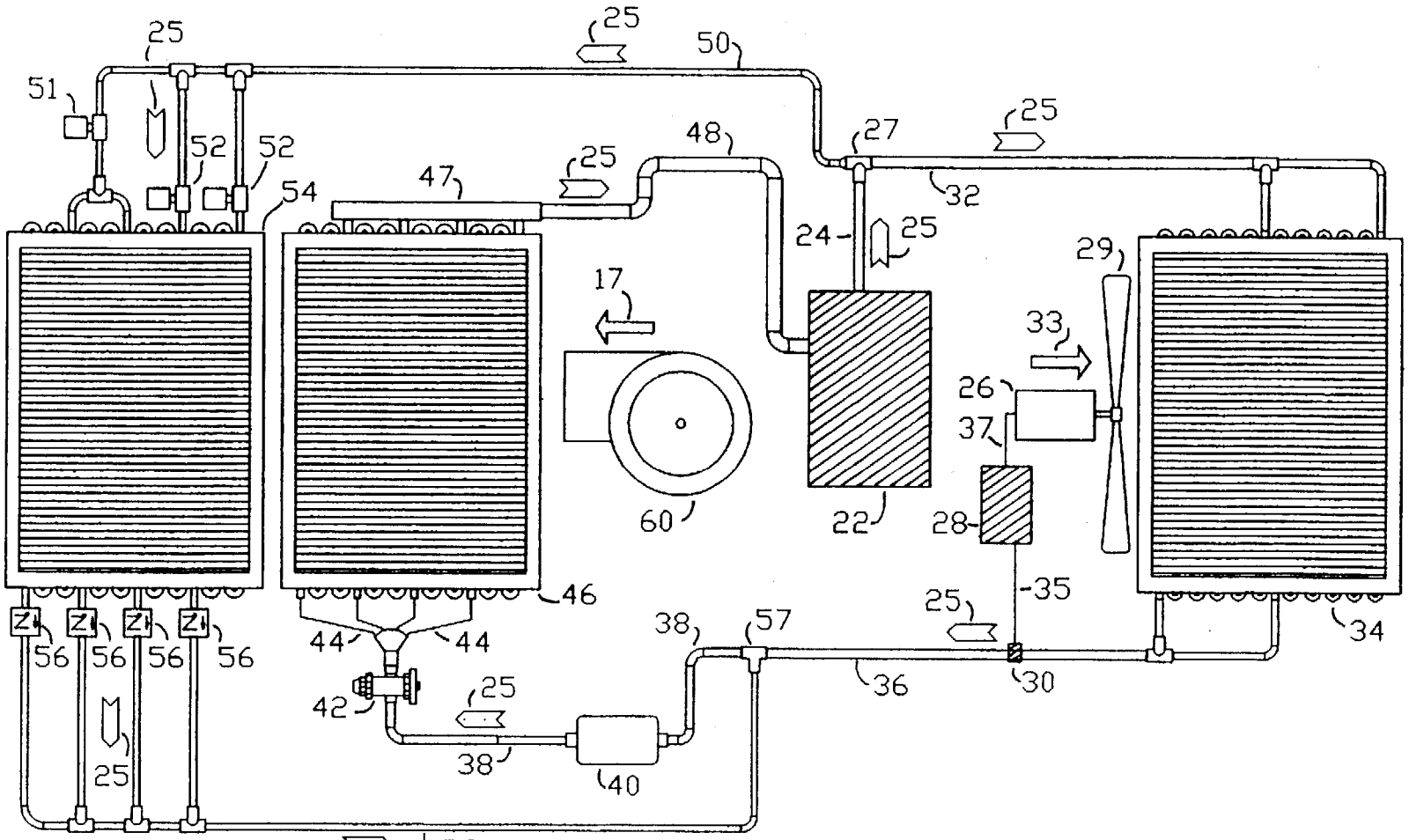
FIG. 4 shows a schematic diagram of the refrigeration components of the present invention. A refrigeration reheat coil using three stop valves is shown, along with all major system components.

FIG. 4 shows another embodiment of the present invention using three refrigerant stop valves. A schematic diagram of the refrigeration system is shown. The refrigerant flow path is shown by refrigerant arrows 25. The cooling only operation is exactly the same as in FIG. 1 and FIG. 2. Therefore, this specification will describe only the refrigeration reheat portion of the present invention. The refrigeration reheat portion of the system begins at the other outlet of hot gas tee 27 as referred to in FIGS. 1 and 2. The inlet of reheat gas line 50 is connected to one outlet of hot gas tee 27. The outlet of reheat gas line 50 is connected to the inlets of two small stop valves 51, and one medium stop valve 53, in a parallel arrangement. The outlets of small stop valves 52, and medium stop valves 51, are connected in a parallel arrangement to the inlets of reheat coil 54. The term "medium stop valve" indicates a valve which is capable of passing one half of the reheat gas in the present invention. The term "small stop valve" indicates a valve sized for one fourth flow. Hot refrigerant gas is condensed in reheat coil 54 and exits as a liquid to the inlet of small check valves 56, which are arranged in a parallel fashion. The outlets of small check valves 56 are connected to indoor liquid line 58. The outlet of indoor liquid line 58 is connected to one of the inlets of liquid line tee 57. As in FIGS. 1 and 2, a check valve is not required in outdoor liquid line 36. The two streams of liquid, one from outdoor liquid line 36, and the other from indoor liquid line 58 join within liquid line tee 57. The outlet of liquid line tee 57 is connected to the inlet of common liquid line 38. Refrigerant then flows through filter drier 40, common liquid line 38, expansion device 42, feeder tubes 44, evaporator coil 46, suction header 47, suction line 48, and compressor 22, back to the point of beginning. Thus a refrigeration loop is completed using both outdoor coil 34, and reheat coil 54, in a parallel arrangement with respect to refrigerant flow.

Condenser fan 29, condenser fan motor 26, pressure controller 28, output wire 37, sensor wire 35, and sensor 30 are positioned in the condenser section 11 as shown in FIGS. 1 and 2, and operate in the same fashion.

During test of the present invention it was found that when two stop valves were energized, the air temperature leaving the reheat coil was approximately 65 degrees. This embodiment provides a more economical version as compared to FIGS. 1, 2, and 3. By energizing two circuits at once using medium stop valve 51, the cost of one stop valve is eliminated. The two remaining steps are used to raise the leaving air temperature to the normal 75 degrees separately by a two stage duct thermostat 108. A two stage duct thermostat 108, which is shown in FIG. 5, is more economical than step controller 107, which is shown in FIG.

Figure 5:
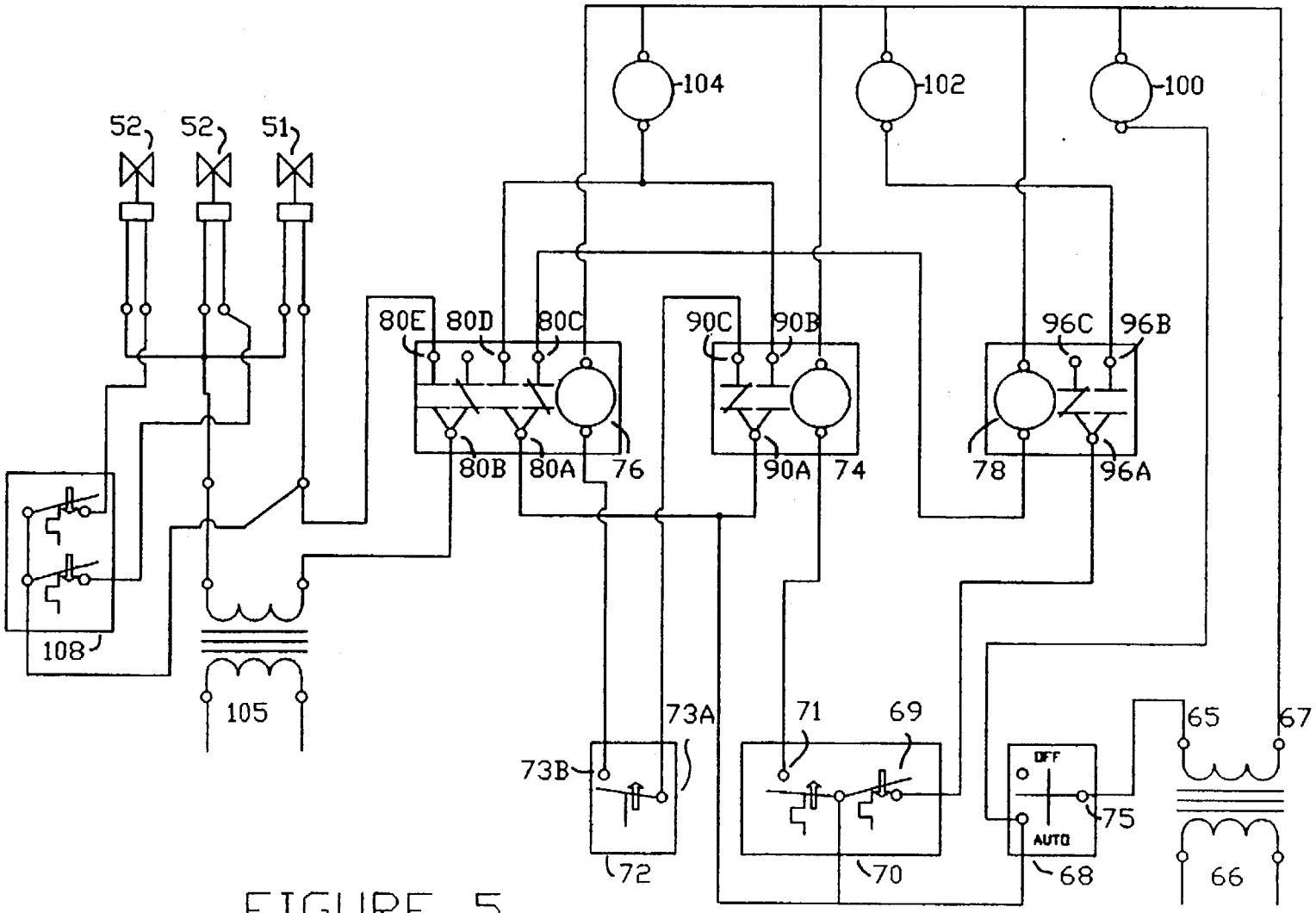
FIG. 5 is an illustration of a typical control wiring diagram for the present invention as constructed in FIG. 4. A two step discharge air control scheme is shown for the refrigeration reheat coil.

FIG. 5 shows a control scheme according to the present invention as described in FIG. 4. All aspects of the control scheme are the same as shown in FIG. 3 except for the control of refrigeration reheat. Therefore only that portion of the controls which pertain to reheat control will be described. Dehumidifying relay 76 connects control power to the reheat system through contacts 80B and 80E. Reheat transformer 105 supplies control power to medium stop valve 53, and small stop valve 52 through the action of contacts 80B and 80E on dehumidifying relay 76. Control power to medium stop valve 51 is supplied without interruption. Control power to small stop valves 52 is supplied through 2 stage duct thermostat 108. FIGS. 4 and 5 are the preferred embodiments of the present invention when the application calls for a large portion of fresh air, and close control parameters are specified.

All embodiments of the present invention exhibited a graduated increase in efficiency during the dehumidification mode of operation. The comparison was made between the dewpoint of the leaving air during cooling only operation versus the leaving dewpoint during the dehumidification mode. All tests were conducted using 100% outdoor air. The results are illustrated below, showing the decrease in the dewpoint during the dehumidification mode:

| OUTDOOR WETBULB TEMP. | OUTDOOR DEWPOINT TEMP. | LEAVING DEWPOINT DURING COOLING | DEWPOINT DECREASE |
|---|---|---|---|
| ABOVE 75 | 72.5 | 58.5 | −3.72 |
| 70–75 | 67.3 | 50.4 | −2.52 |
| BELOW 70 | 60.8 | 43.6 | −1.32 |

The average of all the tests showed an average dewpoint decrease of −2.16 degrees. This shows that the unit according to the present invention performs more efficiently at maximum load conditions. The efficiency gradually declines as the load conditions drop from maximum toward minimum load. Therefore, unit run time during the dehumidification mode is minimized during periods of maximum load, and lengthened during periods of light load. The increased efficiency that occurs during maximum load conditions, saves operation cost. The lengthened run time during low load conditions prevents short compressor cycles. It is well known in the industry, that excessive short cycle operation shortens compressor life. The increase in efficiency is possible because of the series air flow arrangement with regard to evaporator coil 46, and reheat coil 54. Also, reheat coil 54 and outdoor condenser 34, by operating together during dehumidification mode, decrease system pressure, thereby increasing efficiency. If a parallel arrangement were used, the dewpoint leaving the unit would be higher than the leaving dewpoint for a series arrangement. This is because the air stream that leaves the heater portion always contains more moisture than the air stream that leaves the cooling coil portion. The mixing of the two streams will result in a dewpoint temperature somewhere between the two dewpoint temperature streams. With a series arrangement the leaving dewpoint will be equal to, or less than, the dewpoint obtained during cooling only operation.

The embodiments of the present invention all show one stage cooling operation. Multiple stages can be used. One stage is shown in this invention for clarity purposes.

OPERATION—FIGS. 1, 2, 3, 4, 5,

The operation of the present invention will be first described with reference to FIGS. 1, 2 and 3. In FIG. 3 control transformer 66 is energized from a power source not shown. Ground connection 67 on control transformer 66, provides an uninterrupted ground wire connection to all relays. Voltage connection 65 is connected to common point 75 on auto-off switch 68. When manual switch on auto-off switch 68 is rotated to auto connection point, control power is fed to indoor blower relay 100. This action causes indoor blower 60, shown in FIGS. 1 and 2, to begin operating. Return air enters the unit through return inlet 14, and fresh air inlet 16, as shown in FIGS. 1 and 2. These two air streams are mixed and filtered in plenum 18, as shown in FIGS. 1 and 2. Air continues through cooling coil 46, reheat coil 54, and winter heat section 62, exiting the unit at discharge air opening 64, as shown in FIGS. 1 and 2. Control power is also fed at this time to room thermostat 70, contact 80A on relay 76, and contact 90A on relay 74. Control power is also immediately fed through contacts 80A and 80C on relay 76 to relay 78. Relay 78 is energized and contacts 96A to 96B are closed, while 96A to 96C are open. Control power is also fed to dehumidistat 72 contact 73A. When heating contact 69 on room thermostat 70 calls for heat, control power passes from room thermostat 70 through closed contacts 96A and 96B on relay 78, to winter heat relay 102. Therefore, the standard unit heating source is used for winter heating. When the need for heating is satisfied, heating contact 69 on thermostat 70 opens, thus disconnecting control power from winter heat relay 102. When there is a need for cooling, cooling contact 71 on room thermostat 70 closes. Relay 74 is energized and contacts 90A and 90C are opened. Contacts 90A and 90B are closed. This allows control power to energize compressor relay 104. Thus compressor 22, and condenser fan motor 26, are energized, and the air is cooled and dehumidified by evaporator coil 46, as shown in FIGS. 1, and 2. It is typical for condenser fan motors to be energized at the same time as compressors. When compressor 22, and condenser fan motor 26 is energized, sensor 30, senses system pressure through contact with outdoor liquid line 36. A signal is sent to pressure controller 28, through sensor wire 35. Pressure controller 28, controls the speed of condenser fan motor 29, through its connection with output wire 37. System head pressure is maintained at all load conditions in this manner. When cooling demand is satisfied, cooling contact 71 on room thermostat 70 opens and control power is disconnected from cooling relay 74. Relay 74 is deenergized and contacts 90A and 90B are opened, deenergizing compressor relay 104. Contacts 90A and 90C are closed at the same time. Blower 60, as shown in FIGS. 1, and 2, continues to run. When there is a demand for dehumidification, control power is fed to contact 73A on dehumidistat 72, through closed contacts 90A and 90C on relay 74. When contacts 73A to 73B close on dehumidistat 72, relay 76 is energized. Contacts 80A to 80C on relay 76 are opened. This action deenergizes relay 78. contacts 96A to 96C are closed. Contacts 96A to 96B on relay 78 are opened, thus locking out winter heat relay 102. Contacts 80A to 80D on relay 76 are closed and compressor relay 104 is energized. Compressor 22, and condenser fan 26 start and the supply air is cooled by evaporator coil 46, as shown in FIGS. 1 and 2. Pressure controller 28 controls the speed of condenser fan motor 29 as described above. Contacts 80B to 80E on relay 76 are closed when relay 76 is energized by dehumidistat 72. Reheat transformer 105 is now able to supply control power to step controller 107. Step controller 107 controls the on-off action of small stop valves 52 in sequence through sensor 106. Varying amounts of reheat are made available to reheat the air which has been cooled and dehumidified by evaporator coil 46, as shown in FIGS. 1 and 2. Sensor 106 is located in unit discharge air opening 64. Step controller 107 is always set to the same temperature as cooling contact 71 on room thermostat 70. Thus the supply air is always reheated to the space cooling setpoint. Step controller 107, along with its setpoint adjuster is normally located away from the occupied space, so that its setpoint is not normally tampered with. When dehumidification demand is satisfied, control power is removed from relay 76. Thus compressor 22 and all reheat components which were energized through relay 76 cease to operate. Blower 60 continues to operate.

In FIGS. 4 and 5 an embodiment of the present invention is shown using three stop valves in lieu of four as shown in FIGS. 1, 2, and 3. All aspects of the operation of the system with regard to blower operation, cooling operation, and hearing operation are exactly the same as shown in FIGS. 1, 2, and 3. Therefore only the reheat operation will be described since this is the only operation where changes occur in this embodiment. When there is a demand for dehumidification in this embodiment, contacts 80B to 80E on relay 76 energize the control circuit or reheat transformer 105. Reheat transformer 105 energizes medium stop valve 53 immediately. 50% of the reheat gas is allowed to flow through reheat coil 54. The supply air is then reheated to approximately one half of the total temperature rise available from reheat coil 54. Through the closing of contacts 80B and 80E on relay 76, control power from reheat transformer 105 is supplied to duct thermostat 108. Duct thermostat 108 energizes small stop valves 52 in two stages as required to fully reheat the air to the room temperature setpoint. The setpoint of duct thermostat 108 is the same as the cooling setpoint on room thermostat 70. Duct thermostat 108 is normally not located in the space where it can be easily tampered with. When demand for dehumidification is satisfied, contact 73A and 73B, on dehumidistat 72, open and control power is disconnect from all cooling and reheat components. Indoor blower 60, as shown in FIGS. 1 and 2 continues to run.

In all embodiments, when the auto-off switch is manually turned to off, all operations stop.

Accordingly, it can be seen by the reader that the cooling and dehumidifying means with refrigeration reheat, will provide an air conditioning system capable of maintaining stable temperature and humidity conditions at all load points from maximum to minimum. It will be evident that the system, while being more efficient, will provide temperature and humidity control within close parameters, using any proportion of outside air and return air. It will also be evident to the reader that the system can be economically mass produced, using a minimum number of heat exchange and control devices.

Although the description above contains many specifities, these should not be construed as limiting the scope of the invention, but merely providing illustrations of the presently preferred embodiments of this invention. Many other variations are possible. Accordingly, the scope of the invention should be determined not by the embodiments illustrated, but by the appended claims and their legal equivalents.

What I claim is:

1. In a refrigeration apparatus operable to cool and dehumidity air, comprising a compressor, evaporator, refrigerant expansion means, outdoor condenser, air circulating means, and a refrigerant piping means which connects said components in a loop, further comprising a refrigeration reheat piping loop, said loop arranged in a parallel flow relationship with said outdoor condenser, comprising a hot gas tee, hot gas reheat line, multiple flow control means, a multiple circuit refrigeration reheat means, said reheat means being located in series airflow arrangement with said evaporator, multiple liquid line check valves, a liquid line, and a liquid line tee, whereby a system is formed operable to reheat air after it has been cooled and dehumidified, futther comprising a refrigeration head pressure control means, operable to control system pressure during both cooling and dehumidification modes, the improvement comprising a combination of:

(a) a discharge air temperature control means, comprising a discharge air thermostat, said thermosat being electicically connected to said multiple flow control means, and operable to control the discharge air temperature of said reheat means during the dehumidification mode, whereby closer control parameters are maintained in an occupied space.

* * * * *